United States Patent [19]

Dulis et al.

[11] 3,992,202

[45] Nov. 16, 1976

[54] METHOD FOR PRODUCING APERTURE-CONTAINING POWDER-METALLURGY ARTICLE

[75] Inventors: Edward J. Dulis; James N. Fleck, both of Upper St. Clair Township, Allegheny County; Joseph W. Powell, Verona, all of Pa.

[73] Assignee: Crucible Inc., Pittsburgh, Pa.

[22] Filed: Oct. 11, 1974

[21] Appl. No.: 514,042

[52] U.S. Cl. ..... 75/222; 75/223; 75/226

[51] Int. Cl.[2] ..... B22F 314

[58] Field of Search ..... 75/200, 226, 214, 222, 75/208, 223

[56] References Cited

UNITED STATES PATENTS

| | | | |
|---|---|---|---|
| 3,007,744 | 11/1961 | Gordon et al. | 75/222 X |
| 3,168,399 | 2/1965 | Takahashi et al. | 75/226 X |
| 3,313,621 | 4/1967 | Mott | 75/222 |
| 3,531,848 | 10/1970 | Gripshover et al. | 75/208 R |
| 3,571,850 | 3/1971 | Pohto et al. | 75/226 X |
| 3,599,281 | 8/1971 | Boyer | 75/226 X |
| 3,738,830 | 6/1973 | Kimura et al. | 75/214 |
| 3,803,702 | 4/1974 | Bratt et al. | 75/226 X |
| 3,844,778 | 10/1974 | Malone et al. | 75/226 X |

*Primary Examiner*—Richard E. Schafer

[57] ABSTRACT

Method for producing a powder-metallurgy article having at least one aperture therein; the article is produced by providing a dense, nondeformable core having a configuration corresponding to the desired configuration of the aperture in said article; the core is placed in a particle charge having a composition corresponding to that desired in the article; the position of the core within the particle charge corresponds to the desired position of the aperture within the final compacted product. The core has a coefficient of thermal expansion greater than that of said article, whereby after compacting removal of the core from the article to create the aperture is facilitated. A separating medium may be used between the core and the powder. The asembly constituting the container, core and powder is hot isostatically compacted, and upon cooling the container and core are removed from the densified article.

6 Claims, 3 Drawing Figures

METHOD FOR PRODUCING APERTURE-CONTAINING POWDER-METALLURGY ARTICLE

In the manufacture of many powder metallurgy articles, and particularly cutting tools, it is desirable to have an aperture in the article, such as in the case of a hob an axial end-to-end aperture is required to accommodate a shaft. A tool of this type made from bar stock would require that a machining operation be used to produce this axial bore. This results in a loss of material and also incurs an added step in the tool manufacture. This is the case with any article in which, after densification thereof by a conventional powder metallurgy technique, it is necessary to provide an aperture or apertures for any purpose.

It is accordingly a primary object of the present invention to provide a method for producing aperture-containing powder metallurgy articles without requiring a machining operation to form the aperture.

This and other objects of the invention as well as a more complete understanding thereof may be obtained from the following description, specific examples and drawings, in which.

Broadly in the practice of the present invention an assembly is formed of a sealed container having a powder metallurgy charge therein with a core placed within the charge at the location at which the aperture is desired in a final product produced upon the hot isostatic compacting of said charge. The core should be nondeformable under the hot isostatic compacting conditions so that, after compacting and removal of said core, the aperture will have the same configuraion and dimension as the core. To facilitate removal of the core after compacting and cooling, in accordance with the invention the coefficient of thermal expansion of the core should be greater than that of the charge which is compacted to form the article. In this manner, upon cooling the core will by shrinkage separate from the compacted article. The container should be sealable against the atmosphere and collapsible so that by placing the assembly in a conventional autoclave with the assembly being at an elevated temperature compacting by the use of gas under high pressure may be achieved to compact and densify the powder to substantially full density.

To facilitate removal of the core after compacting a separating medium is provided between the core and the particle charge. For this purpose, the core, which may be a dense alloy, may be flame sprayed with various refractory compositions, such as alumina. In addition, compounds formed on the surface, such as oxides or nitrides, would also be effective as a separating medium layer. Preferably the particle charge will be prealloyed powder, such as the type formed by any of the well-known gas-atomizing techniques, of a composition corresponding to that desired in the final compacted article.

Figure 1:
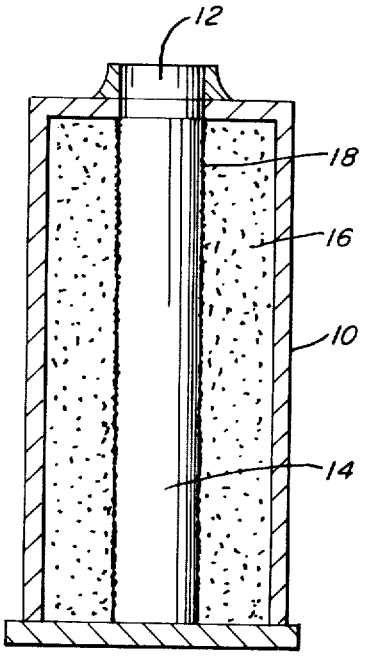
FIG. 1 is a schematic showing in vertical cross-section of an assembly for use with the method of the present invention to produce an aperture-containing powder metallurgy article.
Figure 2:
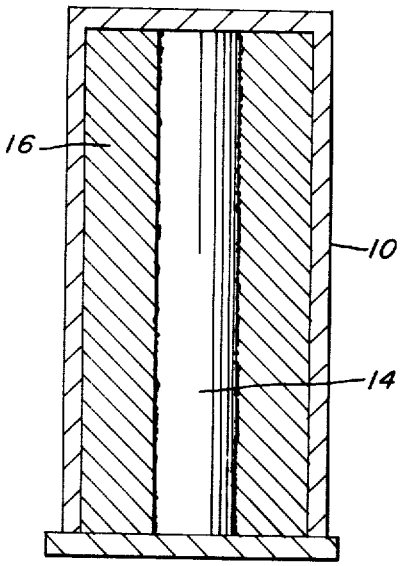
FIG. 2 is a schematic showing of the assembly of FIG. 1 after compacting.
Figure 3:
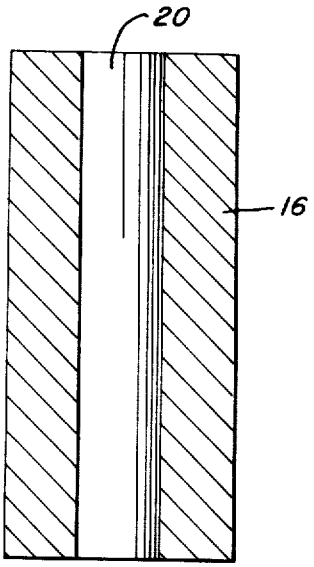
FIG. 3 is a vertical cross section through a compacted article produced in accordance with the invention and using the asssembly of FIG. 1.

With respect to the drawings and for the present to FIG. 1 thereof, there is shown a container 10, which may be of mild steel, having a top opening 12, which may be sealed upon filling of the container and prior to heating and compacting. The container 10 is of cylindrical configuration and has a dense cylindrical alloy core 14 positioned axially therein. The core 14 is surrounded by prealloyed powder 16. The composition of the alloy of the dense core 14 and the composition of the powder 16 should be such as to provide the core with a coefficient of thermal expansion greater than that of the composition of the powder. The surface of the core 14 is provided with a separating medium coating 18, which may be alumina applied thereto by flame spraying. The assembly as described and shown in FIG. 1 would be placed in an autoclave after heating to a suitable compacting temperature, which in the case of high speed steels of the type used in the manufacture of cutting tools, such as hobs, would be on the order of 2000° to 2300° F. Upon heating to this temperature and sealing of the opening 12 in container 10 the same would be placed in an autoclave and subjected to fluid pressure, such as by the application of nitrogen or helium gas as the pressure media at pressures on the order of 10,000 to 15,000 psi. After compacting, the container would be as shown in FIG. 2 with the powder 16 compacted to full density. Upon cooling, the core will shrink away from the compacted particle charge since the separating medium 18 has prevented bonding therebetween. Consequently, the core may be readily removed from the compact and upon removal thereof and of the container 10 the compact will be as shown in FIG. 3. FIG. 3 shows a fully dense article of cylindrical configuration with a cylindrical axial opening 20 therein corresponding to the configuration of the core 14. The article as shown in FIG. 3 would be suitable for the manufacture of a hob upon the machining of cutting surface on the exterior thereof and the appropriate key ways in the aperture 20.

As a specific example of the practice of the invention an assembly similar to that shown in FIG. 1 of the drawings was produced. The core 14 was of an austenitic, high-manganese stainless steel with the core being flame sprayed with alumina. This core was positioned axially within a mild steel container and surrounded by approximately 1.1 in. of AISI M-2 steel powder. The assembly was sealed and upon heating to a temperature of 2075° F placed in an autoclave and hot isostatically compacted by the application of nitrogen gas at a pressure of about 15,000 psi. After compacting the core was readily removed from the compact by the use of a conventional arbor press; the compacted assembly as shown in FIG. 2 of the drawings was supported in upright position on an annular platten positioned beneath the compacted, prealloyed powder, and the ram of the press was lowered into contact with and pushed the core axially from the assembly. In this example the difference in the thermal expansion of the core and alloy material was approximately $3 \times 10^{-6}$/in./in./° F.

We claim:

1. A method for producing a powder metallurgy article having an aperture therein, said method comprising providing a dense core having a configuration corresponding to that of said aperture desired in said article and having a coefficient of thermal expansion greater than that of said article, placing said core in a particle charge of a composition corresponding to that desired in said article, with the position of said core relative to said particle charge corresponding to the desired relative position of said aperture, providing a separating medium between said core and particle charge, sealing said charge and core in a collapsible container to form an assembly, hot isostatically compacting said assembly to produce a densified article from said particle charge with said core not being substantially deformed during said compacting, cooling said assembly and removing said container and said core from said densified article.

2. The method of claim 1 wherein said separating medium is applied to said core.

3. The method of claim 1 wherein said particle charge is substantially fully dense after said hot isostatic compacting.

4. The method of claim 1 wherein said particle charge is prealloyed powder of a composition corresponding to that desired in said article.

5. The method of claim 1 wherein said container is cylindrical and said core is placed axially therein and is surrounded by said particle charge.

6. A method for producing a powder metallurgy article having an aperture therein, said method comprising providing a dense alloy core, said core having a configuration corresponding to that of said aperture desired in said article, having a coefficient of thermal expansion greater that that of said article, and having a separating medium thereon, placing said core in a particle charge of a composition corresponding to that desired in said article, with the position of said core relative to said particle charge corresponding to the desired relative position of said aperture, sealing said charge and core in a collapsible container to form an assembly, hot isostatically compacting said assembly to produce a substantially fully dense article from said particle charge with said core not being substantially deformed during said compacting, cooling said assembly and removing said container and said core from said densified article.

* * * * *